United States Patent [19]

Burke

[11] 4,409,098

[45] Oct. 11, 1983

[54] APPARATUS FOR SEPARATING A MATERIAL OF LIGHTER SPECIFIC GRAVITY FROM A MATERIAL OF HEAVIER SPECIFIC GRAVITY

[76] Inventor: Billy T. Burke, Box 159, Thelma, Ky. 41260

[21] Appl. No.: 362,676

[22] Filed: Mar. 29, 1982

[51] Int. Cl.[3] ..... B03B 5/40

[52] U.S. Cl. ..... 209/172.5

[58] Field of Search ..... 209/172, 172.5, 173

[56] References Cited

U.S. PATENT DOCUMENTS

| | | | |
|---|---|---|---|
| 242,035 | 5/1881 | Peirce | 209/492 |
| 246,706 | 9/1881 | Barber et al. | 209/14 |
| 648,262 | 4/1900 | Honecker | 209/457 |
| 986,581 | 3/1911 | Long | 209/451 |
| 2,825,459 | 3/1958 | Schuetz | 209/172.5 |
| 2,825,460 | 3/1958 | Schuetz et al. | 209/172.5 |
| 2,899,058 | 8/1959 | Tromp | 209/172.5 |
| 3,019,900 | 2/1962 | Lagrost | 209/172 |
| 3,493,108 | 2/1970 | Martinez | 209/172.5 X |

FOREIGN PATENT DOCUMENTS

| | | | |
|---|---|---|---|
| 972363 | 7/1959 | Fed. Rep. of Germany | 209/172.5 |

*Primary Examiner*—Ralph J. Hill

*Attorney, Agent, or Firm*—Frank C. Leach, Jr.

[57] ABSTRACT

A separator tank has a pressurized separating medium of a selected specific gravity introduced through one of its two end walls adjacent the top of the level of the medium, which forms the bath, in the tank. The other end wall of the tank has weir discharge openings to enable the coal, which is separated from the waste of the raw coal through floating to the top of the medium while the waste falls to the bottom of the medium, to flow therethrough with the medium to a weir chute and to maintain a selected level of the medium within the tank. The tank has a paddle wheel assembly to pick up the waste on a semi-cylindrical bottom wall of the tank and remove it therefrom. The paddle wheel assembly has a plurality of equally angularly spaced arms with each including an outer arm, which is resiliently biased to pass over obstructions, having its tip ride along the bottom wall of the tank. The tank has a first pair of baffle plates between which the raw coal is introduced and into which more than half of the medium is introduced. This pair of baffle plates has an exit smaller than the entrance to a second pair of baffle plates, which lead to one of the weir openings receiving the separated coal.

15 Claims, 11 Drawing Figures

APPARATUS FOR SEPARATING A MATERIAL OF LIGHTER SPECIFIC GRAVITY FROM A MATERIAL OF HEAVIER SPECIFIC GRAVITY

This invention relates to an apparatus for separating a material of light specific gravity from a material of heavier specific gravity and, more particularly, to separating coal from raw coal.

One means of separating coal from raw coal, which also includes waste, is to introduce the raw coal into a tank having a bath of a medium with a selected specific gravity. The coal rises to the surface of the bath and flows from the tank through some type of weir opening. The waste collects in the bottom of the tank. It is necessary to remove this waste in some manner in order to not have the tank become filled with the waste.

The apparatus of the present invention provides an improved arrangement for removing the waste on a continuous basis while still separating the coal from the raw coal. The apparatus of the present invention contemplates rotary means to continuously remove the waste from the tank without preventing separation of the coal from the raw coal introduced into the tank.

The rotary means is constructed to have minimum interference with the movement of the coal, which is separated from the raw coal, through the medium in the tank to weir opening means. Thus, the rotary means has a minimum effect upon separation of the coal from the raw coal and its flow to the weir opening means.

The apparatus of the present invention introduces the pressurized medium into the tank in a substantially horizontal direction primarily in the central portion of the separating tank through introducing over half of the medium between a pair of baffle plates with the raw coal also being introduced into this space between the baffle plates. Thus, there is no lift factor exerted by the introduced medium to tend to prevent the waste, which is separated from the coal, from falling to the bottom of the tank. The pressurized medium also is introduced exteriorly of the baffle plates and directed to act upon the substantially semi-cylindrical bottom wall of the tank sufficiently to cause the separated coal, which is not within the baffle plates, to be directed back toards the weir opening means.

To aid in insuring that the separated coal flows through the weir opening means, the apparatus of the present invention has a second pair of baffle plates extending from the end wall having the weir opening means. The weir opening means includes openings exterior of each of the second pair of baffle plates to receive any of the separated coal, which might not flow between the second pair of baffle plates to the opening of the weir opening means between the second pair of baffle plates.

The apparatus of the present invention is essentially a closed system in that the medium with the waste is recovered as is the medium flowing through the weir opening means with the separated coal. Thus, the amount of water discharged from the apparatus of the present invention is a minimum so as to not cause any ecological problems with the ground.

The apparatus of the present invention may be mounted on a support structure capable of being moved from one area to another. Therefore, the apparatus of the present invention is portable so as to be capable of being moved to various mining areas after one mining area has been depleted. This reduces the amount of travel of raw coal to the separating apparatus of the present invention.

Through selecting the specific gravity of the medium, the user of the apparatus of the present invention is able to obtain coal of a selected specific gravity. This enables the user of the apparatus of the present invention to produce coal having a specific BTU since it can be determined what specific gravity of the coal will produce a specific BTU when separated from the waste.

The apparatus of the present invention introduces the raw coal between the baffle plates at a selected angle, which is preferably between 30° and 45°, to direct the raw coal towards the bottom of the separating tank. This insures that only the separated coal will be in the top portion of the medium to flow out of the tank through the weir opening means, particularly in view of the introduction of the medium in a substantially horizontal direction rather than in a vertical direction since this vertical introduction direction would tend to lift the raw coal towards the top of the medium in the tank.

The apparatus of the present invention is capable of having the waste removed from either side of the tank. This is accomplished through mounting the rotary means to rotate in either direction in accordance with the side of the tank in which the waste is to be collected.

An object of this invention is to provide an apparatus for separating material below a selected specific gravity from a material of higher specific gravity.

Another object of this invention is to provide an apparatus for separating coal from raw coal to obtain coal of a specific gravity and a specific BTU value.

Other objects of this invention will be readily perceived from the following description, claims, and drawings.

This invention relates to an apparatus for separating a material of lighter specific gravity from a material of heavier specific gravity including a tank to receive the material to be separated with the tank having an open upper end, a substantially semi-cylindrical bottom wall, and two end walls. The material is introduced into the tank through its open upper end at a selected angle by material introducing means. Medium introducing means introduces a separating medium of a selected specific gravity under pressure into the tank in a substantially horizontal direction through one of its end walls with the other of the end walls having opening means therein to control the level of the medium in the tank and to allow the separated material of lighter specific gravity to flow from the tank. First baffle means extends from the one end wall for a selected distance and second baffle means extends from the other end wall for a selected distance so as to have its end spaced from the end of the first baffle means with the first baffle means having its exit aligned with the entrance of the second baffle means. Rotary means moves along the substantially semi-cylindrical bottom wall of the tank to remove the material of heavier specific gravity therefrom.

The attached drawings illustrate a preferred embodiment of the invention, in which.

Figure 1:
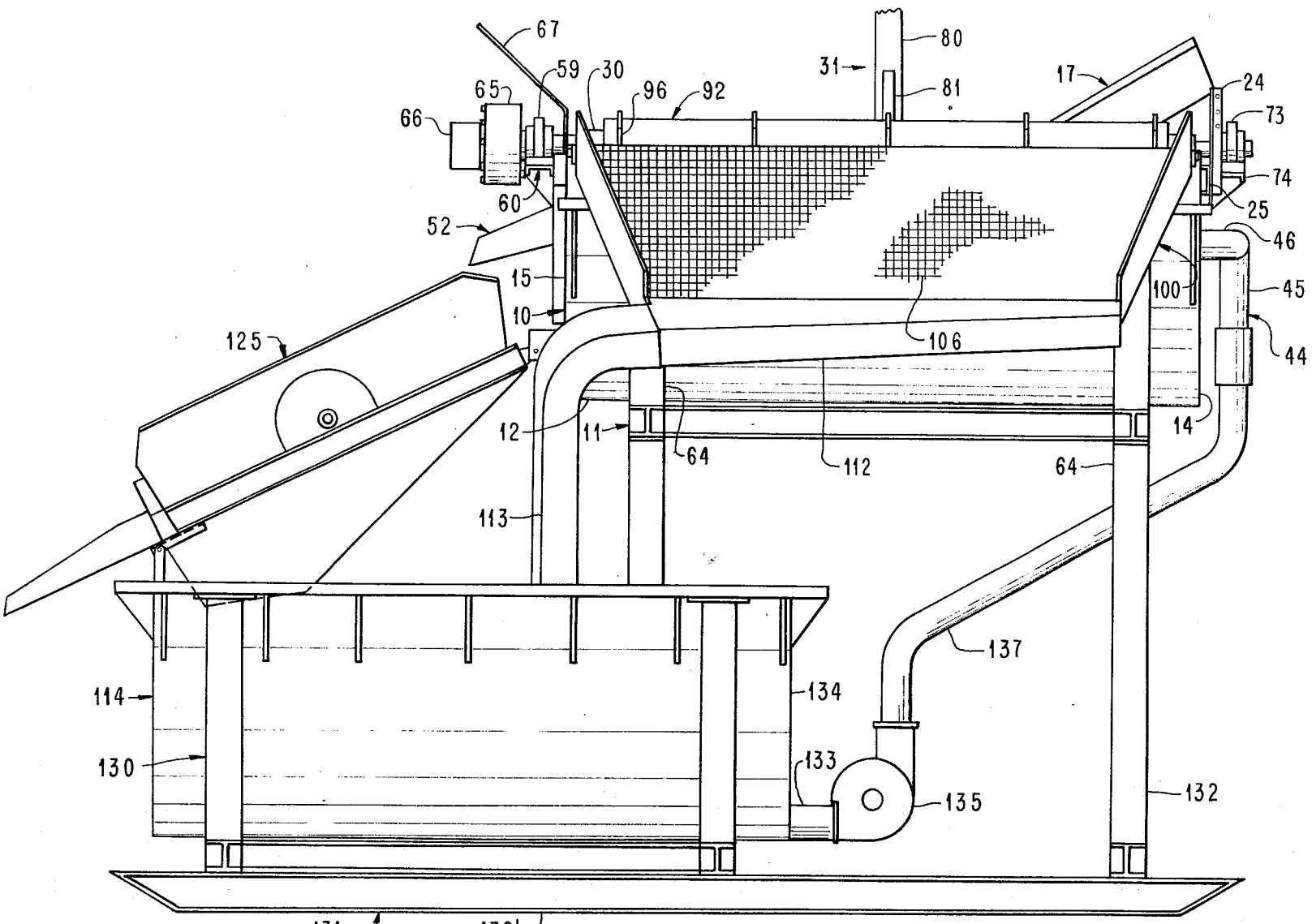
FIG. 1 is a side elevational view of the separating apparatus of the present invention with some parts omitted for clarity purposes.

Referring to the drawings and particularly FIG. 1, there is shown a separating tank 10, which is supported by a cradle assembly 11. The tank 10 has a substantially semi-cylindrical circular bottom wall 12 closed at its opposite ends by end walls 14 and 15.

The tank 10 has its upper end open to receive materials of lighter specific gravity and heavier specific gravity. One example of such materials is raw coal in which coal of a selected specific gravity is separated from waste, which has a higher specific gravity than the coal.

Figure 7:
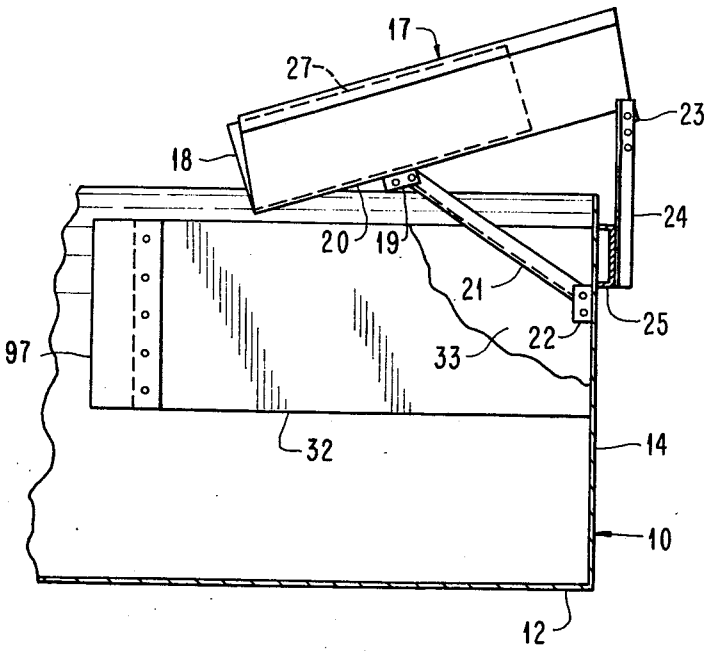
FIG. 7 is an enlarged fragmentary elevational view showing the arrangement for mounting the material feed chute relative to the separator tank.

The raw coal is supplied to the tank 10 at a desired angle through a feed chute assembly 17. The feed chute assembly 17 includes a feed chute 18 (see FIGS. 7, 10, and 11), which can be disposed at various angles (preferably 30° to 45°) to have the raw coal enter the tank 10 at a desired angle. The angular entrance of the raw coal into the tank 10 is selected so that the raw coal is separated in the upper one third of the tank 10, which has a medium therein of a selected specific gravity forming a bath, and only the separated coal of the desired specific gravity will float to the top of the medium in the tank 10.

The feed chute 18 has a pair of attachment mounts 19 on its bottom wall 20 with each of the attachment mounts 19 attached to one of a pair of angle irons 21. The lower end of each of the angle irons 21 is connected to an attachment mount 22. The two attachment mounts 22 are fixed to the inner surface of the end wall 14.

Figure 3:
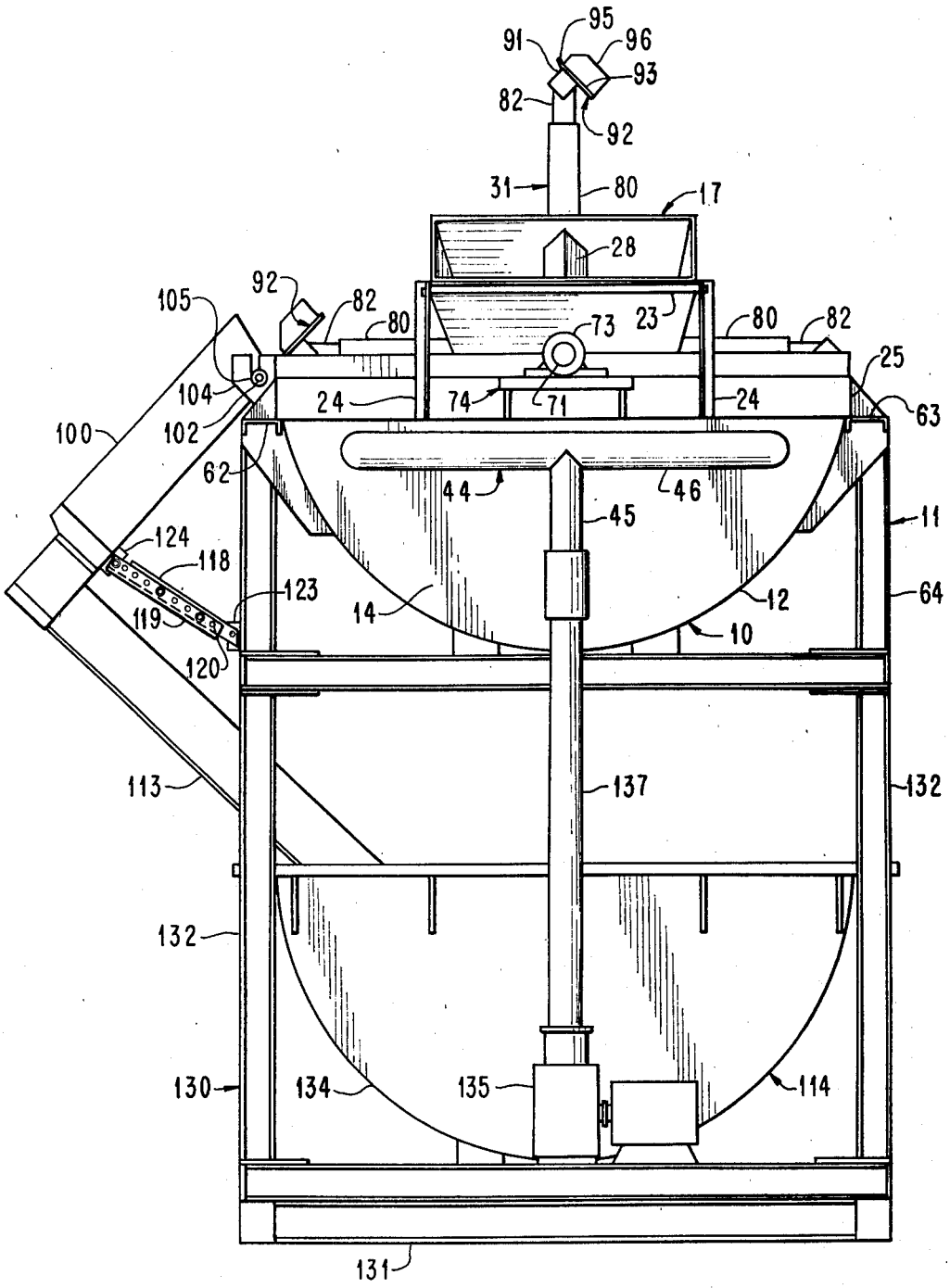
FIG. 3 is an end elevational view taken from the inlet end of the separating apparatus of FIG. 1.

The upper end of the inclined feed chute 18 rests on a horizontally disposed angle iron 23, which extends between a pair of vertical angle irons 24 as shown in FIG. 3. The vertical angle irons 24 are connected to a rear channel 25, which is fixed to the end wall 14 of the tank 10.

Figure 10:
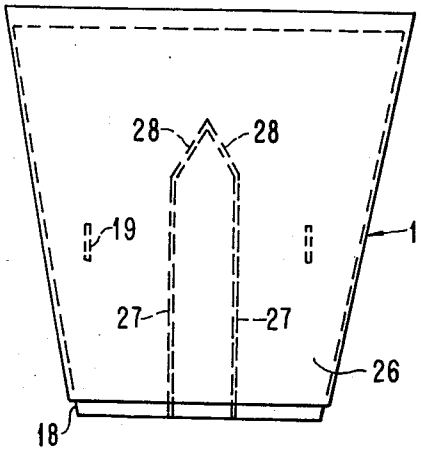
FIG. 10 is a fragmentary top plan view of the feed chute assembly of the separating apparatus of FIG. 1.

The feed chute assembly 17 includes a cover 26, which is mounted on top of the U-shaped feed chute 18 to form an enclosed passage for the raw coal. The feed chute 18 has its side walls converging from its upper end to its lower end as shown in FIG. 10.

It should be understood that the raw coal is introduced into the upper end of the feed chute assembly 17 only after it has been passed over a shaker screen or other suitable means to remove particles of raw coal below a predetermined size and known as fines. The fines would be collected in a suitable collection means.

Figure 11:
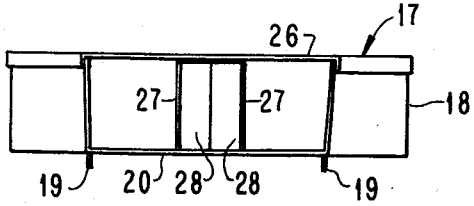
FIG. 11 is an end elevational view, taken from the discharge end, of the feed chute assembly of FIG. 10.

A pair of divider blades 27 is fixed to the bottom wall 20 of the feed chute 18. Each of the divider blades 27 terminates just short of the cover 26 as shown in FIG. 11. The divider blades 27 have bent portions 28 (see FIG. 10) cooperating with each other to separate the raw coal into two passages or paths when flowing through the feed chute 18.

These two paths of the raw coal pass on opposite sides of a rotatably supported axle 30 (see FIG. 1) of a paddle wheel assembly 31. The two paths of coal then fall into a medium within the tank 10 in the space between a pair of baffle plates 32 (see FIG. 2) and 33, which comprise baffle means.

The baffle plates 32 and 33 extend from the end wall 14 of the tank 10 to which they are secured. A brace 34 extends between the baffle plates 32 and 33 to support them and hold them in their substantially parallel relationship. A cross brace 35 extends between the baffle plate 32 and a portion of the brace 34 adjacent the baffle plate 33 to add further rigidity. The raw coal is introduced into the tank 10 between the baffle plates 32 and 33 on the side of the brace 34 remote from the cross brace 35.

The tank 10 has a second baffle means, which comprises a pair of baffle plates 36 and 37 extending from the end wall 15 of the tank 10. The baffle plates 36 and 37 are held in a diverging relationship by a brace 38 and a cross brace 39. The entrance to the second baffle means, which is defined by the free ends of the baffle plates 36 and 37, is larger than its exit. Furthermore, both the entrance and the exit between the baffle plates 36 and 37 are larger than the exit between the baffle plates 32 and 33.

The medium is introduced under pressure into the tank 10 through four openings 40 (see FIG. 4), 41, 42, and 43 in the end wall 14. The openings 41 and 42, which are circular, communicate with the tank 10 in the space between the baffle plates 32 (see FIG. 2) and 33 while the openings 40 (see FIG. 4) and 43, which are portions of a circle, communicate with the tank 10 exterior of the space between the baffle plates 32 (see FIG. 2) and 33 and direct the medium against the substantially semi-cylindrical bottom wall 12.

Figure 2:
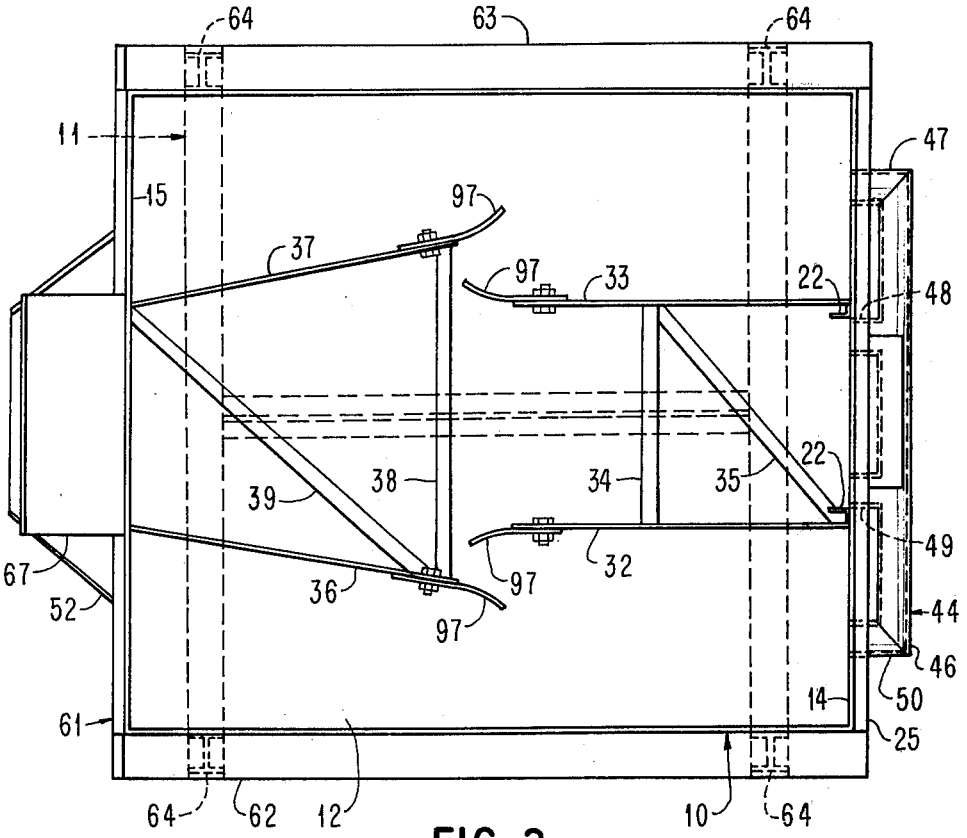
FIG. 2 is a top plan view of a separator tank of the separating apparatus of the present invention and its support arrangement.

The medium is supplied to the openings 40–43 (see FIG. 4) through a manifold assembly 44 (see FIG. 2). The manifold assembly 44 includes an upright supply pipe 45 (see FIGS. 1 and 3) through which the medium is supplied under pressure to a horizontally disposed distribution pipe 46, which communicates with the openings 40 (see FIG. 4), 41, 42, and 43 through connecting pipes 47 (see FIG. 2), 48, 49, and 50, respectively.

The openings 40–43 (see FIG. 4) are located adjacent the top of the end wall 14 so that the medium is introduced in the top portion of the bath within the tank 10. The pressure of the medium is controlled so that it creates a flow toward an outlet opening 51 in the end wall 15 of the tank 10 between the baffle plates 36 (see FIG. 2) and 37. The separated coal flows through the outlet opening 51 (see FIG. 4) while the waste falls to the bottom of the tank 10 because it has a higher specific gravity than the specific gravity of the medium. The outlet opening 51 is disposed in the end wall 15 to control the height of the bath within the tank 10 while still having flow from the bath through the opening 51.

Approximately seventy percent of the flow of the medium enters the tank 10 through the openings 41 and 42 to flow between the baffle plates 32 (see FIG. 2) and 33. The sizes of the openings 40 (see FIG. 4) and 43 are selected at the time of manufacture to control the amount and direction of flow therethrough.

The majority of the coal is separated from the raw coal between the baffle plates 32 (see FIG. 2) and 33 and flows with the medium to the space between the baffle plates 36 and 37 and then through the outlet opening 51 (see FIG. 4) in the end wall 15 of the tank 10. The opening 51 allows the coal to flow with the medium therefrom onto a weir chute 52, which is secured to the end wall 15.

While the majority of the coal is separated between the baffle plates 32 (see FIG. 2) and 33 and flows with the medium to the space between the baffle plates 36 and 37 and then through the outlet opening 51 (see FIG. 4), some of the separated coal is exterior of the baffle plates 32 (see FIG. 2) and 33 because the baffle plates 32 and 33 do not extend to the bottom of the substantially semi-cylindrical bottom wall 12 of the tank 10. This separated coal flows through a pair of outlet openings 53 (see FIG. 4) in the end wall 15 of the tank 10 on opposite sides of the outlet opening 51 and exterior of the baffle plates 36 (see FIG. 2) and 37. The weir chute 52 also receives the coal flowing through the outlet openings 53 (see FIG. 4) in addition to the coal flowing through the outlet opening 51.

As previously mentioned, the paddle wheel assembly 31 (see FIG. 5) includes a horizontally disposed axle 30. The axle 30, which is a square shaped hollow tube, has a driven axle shaft 55 disposed at one end thereof and a support axle shaft 56 disposed at its other end. The driven axle shaft 55 includes a first circular shaped portion 57 disposed within the hollow axle 30 and secured thereto by suitable means such as welding, for example. The driven axle shaft 55 also includes a second circular shaped portion 58, which is rotatably supported within a pillow block 59 (see FIG. 1) and of smaller diameter than the portion 57. The pillow block 59 is supported on a front bearing mount 60, which is supported on a front channel assembly 61 (see FIG. 4).

The front channel assembly 61 extends between a pair of side channels 62 and 63, which support the front channel assembly 61 above the top of the tank 10. The side channels 62 and 63 are supported by vertical legs 64 of the cradle assembly 11.

The circular portion 58 (see FIG. 5) of the driven axle shaft 55 has a keyway formed therein to be keyed to a shaft of a gear reducer 65 (see FIG. 1), which also is carried by the front bearing mount 60. The gear reducer 65 is driven from a hydraulic motor 66, which is supported by the gear reducer 65.

A cover 67 is mounted on the end wall 15 of the tank 10 to overlie the pillow block 59, the gear reducer 65, and the hydraulic motor 66. The cover 67 has a square shaped opening 68 (see FIG. 4) to have the first circular shaped portion 57 (see FIG. 5) of the driven axle shaft 55 pass therethrough.

The support axle shaft 56 includes a first portion 70 of circular shape and a second portion 71 of circular shape and smaller diameter than the first portion 70. The first circular portion 70 of the support axle shaft 56 is disposed within the hollow axle 30 and secured thereto by suitable means such as welding, for example.

The second circular portion 71 of the support axle shaft 56 is rotatably supported in a pillow block 73 (see FIG. 1), which is supported by a rear bearing mount 74. The rear bearing mount 74 is supported by the rear channel 25, which extends between the side channels 62 (see FIG. 2) and 63 is supported thereby. Accordingly, the axle 30 (see FIG. 1) is rotatably supported by the pillow blocks 59 and 73 and rotatable by the hydraulic motor 66.

Figure 6:
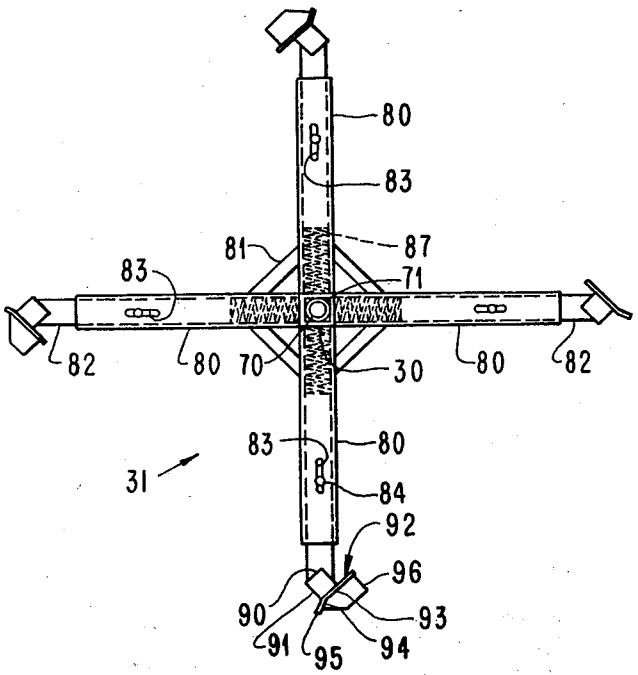
FIG. 6 is an end elevational view of the paddle wheel assembly of FIG. 5.

The paddle wheel assembly 31 (see FIG. 6) includes a plurality (four shown) of equally angularly spaced inner arms 80 attached to the axle 30 by any suitable means such as welding, for example. Each of the inner arms 80 is a square shaped hollow tube of the same size as the axle 30.

A brace 81 extends between each pair of the inner arms 80 to add further rigidity and support thereto. Each of the braces 81 also is a square shaped hollow tube. The braces 81 are located so that they do not extend into the medium during rotation of the paddle wheel assembly 31.

Each of the inner arms 80 has an outer arm 82, which is a square shaped hollow tube, slidably disposed therein. Each of the inner arms 80 has a pair of longitudinal slots 83 formed in parallel walls thereof. A bolt 84 extends through one of the longitudinal slots 83 in the inner arm 80 and through a pair of aligned holes (not shown) in the outer arm 82 in a pair of parallel walls of the outer arm 82 and through the other of the longitudinal slots 83. A nut 86 (see FIG. 5) is secured to the bolt 84. Accordingly, the amount of movement of each of the outer arms 82 relative to the supporting inner arm 80 is controlled by the length of the longitudinal slot 83 (see FIG. 6). Each of the outer arms 82 is urged outwardly from the supporting inner arm 80 by a spring 87, which has its ends engaging a wall of the axle 30 and the inner end of the outer arm 82.

Each of the outer arms 82 has a V-shaped slot 90 in its outer end to have portions of two adjacent walls of a longitudinal support 91, which is a square shaped hollow tube, abut thereagainst and be welded thereto. The support 91 has a paddle blade 92, which is the same length as the support 91, welded thereto.

The paddle blade 92 has a first portion 93 with a part thereof bearing against the support 91 and welded thereto. The paddle blade 92 also includes a second portion 94, which is at an angle to the first portion 93 and has its tip 95 engaging the inner surface of the substantially semi-cylindrical bottom wall 12 (see FIG. 4) of the tank 10 because of the spring 87 (see FIG. 6) urging the outer arm 82 outwardly. Thus, as the axle 30 is rotated, each of the tips 95 moves along the inner surface of the substantially semi-cylindrical bottom wall 12 (see FIG. 4) of the tank 10 to pick up any waste therein. If any rigid piece of material such as a roof bolt, for example, should be engaged by the tip 95 (see FIG. 6), the spring 87 allows retraction of the outer arm 82 into the inner arm 80 sufficiently to clear the rigid piece of material.

Each of the paddle blades 92 has a plurality (five shown in FIG. 5) of fins 96 mounted on the first portion 93 and spaced substantially equal distances from each other. The fins 96 prevent waste from moving along the paddle blade 92 so that there is substantially equal distribution of the waste along the paddle blade 92 during rotation thereof.

During rotation of the paddle wheel assembly 31, each of the inner arms 80 and the outer arms 82 passes between the spaced ends of the baffle plates 32 (see FIG. 2) and 33 and the baffle plates 36 and 37. It should be understood that the supports 91 (see FIGS. 5 and 6) and the paddle blades 92 do not pass through this space.

To reduce disruption of the flow of the separated coal with the medium from the space between the baffle plates 32 (see FIG. 2) and 33 to the space between the baffle plates 36 and 37, each of the baffle plates 32, 33, 36, and 37 has a baffle flap 97, which is a rubber belt, for example, of the same ¼" thickness as the baffle plates 32, 33, 36, and 37 mounted on its outer surface and extending into overlapping relation with the baffle flap 97 on the adjacent baffle plate of the other baffle means. The baffle flaps 97 are secured through bolts and nuts to the baffle plates 32, 33, 36, and 37. The baffle flaps 97, which extend for the same vertical distance as each of the baffle plates 32, 33, 36, and 37, maintain the space through which the inner arms 80 (see FIGS. 5 and 6) and the outer arms 82 rotate substantially closed while allowing the inner arms 80 and the outer arms 82 of the paddle wheel assembly 31 to move therethrough without retarding the rotation of the paddle wheel assembly 31.

As each of the tips 95 clears the top of the tank 10 (see FIG. 3), the waste material thereon falls into a reject chute assembly 100. The reject chute assembly 100 can be mounted on either side of the tank 10 depending upon the direction of rotation of the paddle wheel assembly 31.

Figure 8:
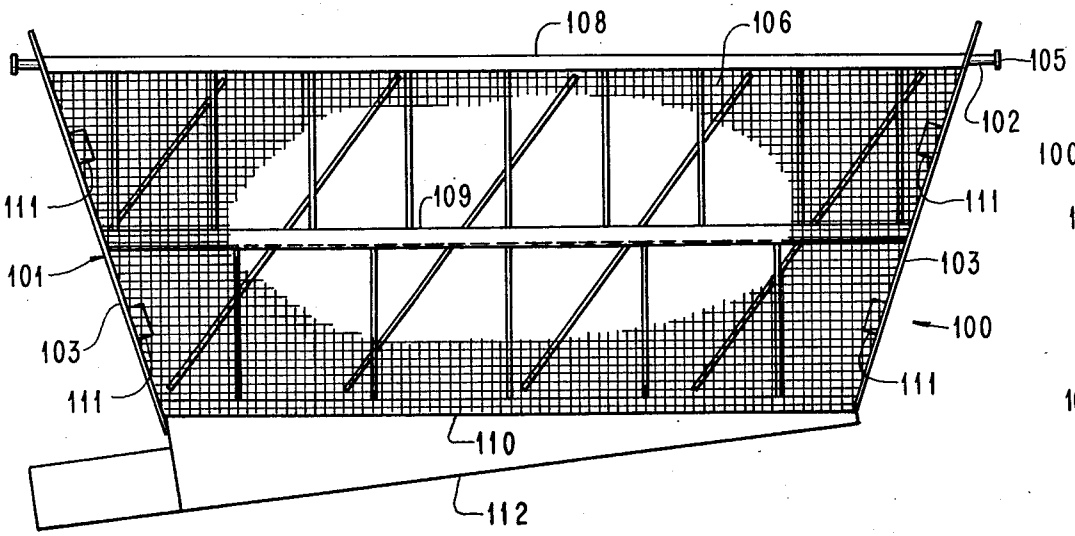
FIG. 8 is a top plan view of a reject chute assembly of the separating apparatus of FIG. 1.

The reject chute assembly 100 includes a U-shaped chute 101 (see FIG. 8) having a rod 102 extending from each of its side walls 103. The rods 102 are disposed in a pair of attachment mounts 104 (see FIGS. 3 and 4), which are supported on opposite ends of one of the side channels 62 and 63 depending on the direction of rotation of the paddle wheel assembly 31, to mount the reject chute assembly 100. Each of the rods 102 has a washer 105 thereon to prevent any accidental displacement from the attachment mount 104.

Figure 9:
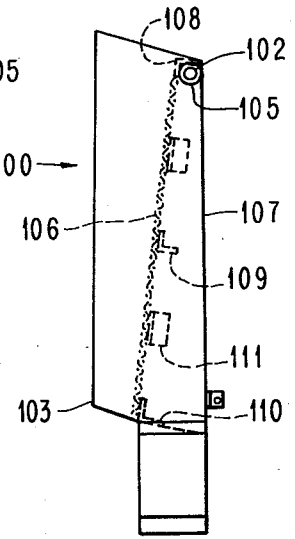
FIG. 9 is a side elevational view of the reject chute assembly of FIG. 8.

A screen 106 (see FIGS. 8 and 9) is supported within the chute 101 in spaced relation to bottom wall 107 (see FIG. 9) of the U-shaped chute 101. The screen 106 is supported by supports 108 (see FIG. 8), 109, and 110, which extend between the side walls 103 of the U-shaped chute 101 and cause the screen 106 to be inclined relative to the bottom wall 107 (see FIG. 9) of the chute 101. Each of the side walls 103 (see FIG. 8) also has a pair of guide supports 111 to support the screen 106. Accordingly, as the waste and the medium flow into the reject chute assembly 100, the waste collects on the screen 106 while the medium flows through the screen 106 into a U-shaped collection chute 112, which is supported at the lower end of the chute 101. The U-shaped collection chute 112 has a duct 113 (see FIG. 1) connected thereto to return the medium to a sump 114.

The waste, which collects on the screen 106, falls therefrom by gravity into a suitable collection means. The lower end of the reject chute assembly 100 is mounted at a selected angle to insure that the waste moves by gravity along the screen 106 to the suitable collection means.

A pair of brace assemblies 117 (see FIG. 4) is supported between the cradle assembly 11 and the reject chute assembly 100 to enable the reject chute assembly 100 to be mounted at the selected angle. Each of the brace assemblies 117 includes a pair of nesting angle irons 118 and 119 with each having a plurality of openings 120 therein. Bolts pass through some of the openings 120 in each of the angle irons 118 and 119 and cooperate with nuts to connect the nesting angle irons 118 and 119 to each other so that they have a total over-all selected length.

The angle iron 118 is attached to a mount 123, which is fixed to one of the vertical legs 64 of the cradle assembly 11, by a bolt and nut. The bottom wall 107 of the chute 101 has a pair of mounts 124 thereon to enable the angle iron 119 of each of the brace assemblies 117 to be secured thereto by a bolt passing through an opening in one of the mounts 124 and an opening in the secured angle iron 119 and a nut cooperating with the bolt.

The chute 101 is inclined closer to the vertical as the size of the waste material increases. This produces maximum dewatering, which is removal of the medium from the waste for use again by return to the sump 114 (see FIG. 1).

The sump 114, which is a tank having the same shape and size as the tank 10 so that it has an open upper end and a substantially semi-cylindrical bottom wall, is disposed beneath the weir chute 52. The weir chute 52 has dewatering means 125 including screens for enabling the medium, which flows along the weir chute 52 with the separated coal, to flow therethrough to the sump 114 while the coal, which floats out of the tank 10 with the medium, moves along the top of the screens of the dewatering means 125 to be collected at a suitable location. For example, the coal may be directed to a conveyor belt for transport to collection means. One suitable example of the dewatering means 125 is a double deck screen three feet by six feet sold by Powerscreen.

The sump 114 is supported by a cradle assembly 130, which is supported on a support assembly 131. The support assembly 131 also has a vertical legs 132 for supporting the cradle assembly 11 in vertically spaced relation above the sump 114. The support assembly 131 is capable of being towed as it has runners 132' as its base.

The sump 114 has a pipe 133 extending from its end wall 134 and connected to the suction side of a pump 135. One suitable example of the pump 135 is sold by Goyne as model 5000 and has a capacity of 600 to 900 gallons per minute. Any other suitable pump may be employed.

The discharge side of the pump 135 is connected by piping 137 to the upright supply pipe 45 of the manifold assembly 44. Thus, this supplies the pressurized medium to the tank 10.

Considering the operation of the apparatus of the present invention, the raw coal is introduced into the tank 10 through the feed chute assembly 17, which is at the desired angle between the baffle plates 32 (see FIG. 2) and 33. This insures that the waste, which is separated from the coal by the medium in the tank 10, tends to settle around the portion of the paddle wheel assembly 31 (see FIGS. 5 and 6) having the arms 80 and 82 so as to have the heavier portions in the center of each of the paddle blades 92.

Figure 4:
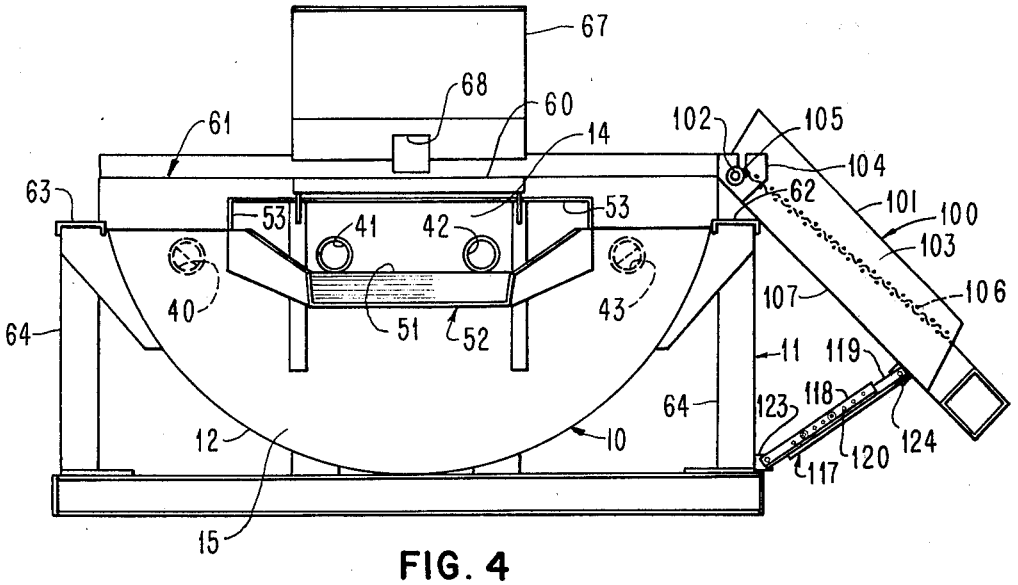
FIG. 4 is an end elevational view of the separator tank of FIG. 2 and taken from the discharge end of the separating apparatus of FIG. 1.
Figure 5:
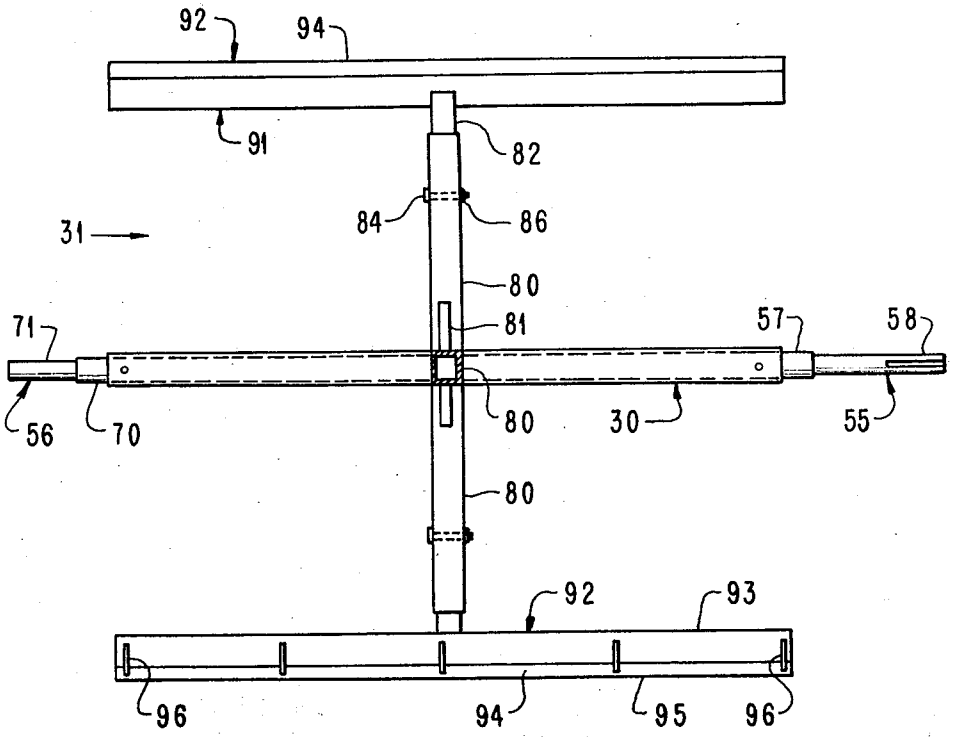
FIG. 5 is a top plan view of a paddle wheel assembly of the separating apparatus of FIG. 1.

The relationship of the exit of the space between the baffle plates 32 (see FIG. 2) and 33 with respect to the entrance to the baffle plates 36 and 37 insures that the separated coal primarily flows between the baffle plates 36 and 37 and through the opening 51 (see FIG. 4). Any coal, which does not pass between the baffle plates 36 (see FIG. 2) and 37 but is exterior thereof, escapes through the openings 53 (see FIG. 4) in the end wall 15 to also be collected on the weir chute 52.

As the waste settles to the bottom of the tank 10, it is picked up by the tip 95 (see FIG. 6) of the second portion 94 of each of the paddle blades 92 and moved along the substantially semi-cylindrical bottom wall 12 (see FIG. 4) until the top of the substantially semi-cylindrical bottom wall 12 is reached. Then, the waste falls into the reject chute assembly 100 where the medium is separated therefrom for return to the sump 114 (see FIG. 1) by the duct 113.

The medium in the sump 114 is periodically tested to insure that it has the desired specific gravity. When the specific gravity of the medium is outside the desired range, then new material such as magnetite, for example, must be added, or water must be added depending upon whether the specific gravity has decreased or increased.

If any type of rigid material such as a roof bolt, for example, should be included in the raw coal introduced into the tank 10, any of the outer arms 82 (see FIG. 6) having the tip 95 engage against the roof bolt would be moved against the force of the spring 87 to prevent jamming of the outer arm 82. If the pressure on any of the outer arms 82 should increase beyond a predetermined amount, the hydraulic motor 66 (see FIG. 1) will cease to rotate the paddle wheel assembly 31 because of a safety by-pass valve in the hydraulic motor 66 being responsive to this pressure on the outer arm 82 (see FIGS. 5 and 6).

While the paddle wheel assembly 31 has been described as having four of the inner arms 80, the outer arms 82, and the paddle blades 92, it should be understood that any suitable number could be employed as long as they were equally angularly spaced. For example, eight of the inner arm 80, the outer arms 82, and the paddle blades 92 could be utilized if desired.

While the apparatus of the present invention has been shown and described with respect to separating coal of a selected specific gravity from raw coal, it should be understood that the apparatus may be utilized whenever it is desired to separate a material of lighter specific gravity from a material of heavier specific gravity.

An advantage of this invention is that there can be no damage to the drive mechanism through encountering objects in the separator that would tend to jam the rotating paddle wheel assembly. Another advantage of this invention is that the hydraulic motor cannot be burned out. A further advantage of this invention is that it avoids any lift factor in the bath from the introduced pressurized medium to lift the waste upwardly since the pressurized medium is introduced at the top of the bath. Still another advantage of this invention is that it creates a medium flow to insure that the separated coal of the selected specific gravity is removed from the separating tank. A still further advantage of this invention is that the apparatus is portable if desired.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. An apparatus for separating a material of lighter specific gravity from a material of heavier specific gravity including:

a tank to receive the material to be separated;

said tank having an open upper end, a substantially semi-cylindrical bottom wall, and two end walls;

material introducing means to introduce the material to be separated into said tank through said open upper end at a selected angle;

medium introducing means to introduce a separating medium of a selected specific gravity under pressure into said tank in a substantially horizontal direction through one of said end walls;

the other of said end walls of said tank having opening means therein to control the level of the medium in said tank and to allow the separated material of lighter specific gravity to flow from said tank;

first baffle means extending from said one end wall for a selected distance;

second baffle means extending from said other end wall for a selected distance so as to have its end spaced from the end of said first baffle means, said first baffle means having its exit aligned with the entrance of said second baffle means;

and rotary means to move along said substantially semi-cylindrical bottom wall of said tank to remove the material of heavier specific gravity therefrom.

2. The apparatus according to claim 1 in which said rotary means includes:

a rotatably supported driven axle disposed above the top of said tank;

a plurality of first arms supported by said axle for rotation therewith and extending radially therefrom, each of said first arms passing between the spaced ends of said first baffle means and said second baffle means during rotation of said axle;

and each of said first arms supporting resilient engaging means to move along said substantially semi-cylindrical bottom wall between said end walls of said tank to remove the material of heavier specific gravity from said tank while being capable of moving away from said substantially semi-cylindrical bottom wall when encountering a relatively rigid piece of material.

3. The apparatus according to claim 2 in which each of said resilient engaging means includes:

a second arm slidably mounted on said first arm and passing between the spaced ends of said first baffle means and said second baffle means during rotation of said axle;

means to resiliently connect said second arm to said first arm;

and said second arm having means at its end remote from said first arm for engaging said substantially semi-cylindrical bottom wall between said end walls of said tank for substantially the entire distance between said end walls of said tank.

4. The apparatus according to claim 3 in which said remote means includes:

a support element fixed to said second arm and extending for substantially the distance between said end walls of said tank;

and a paddle having a first portion fixed to said support element and a second portion at an angle to said first portion and having its tip urged into engagement with said substantially semi-cylindrical bottom wall by said resiliently connecting means, said paddle extending substantially the same distance as said support element.

5. The apparatus according to claim 4 in which said first baffle means has its exit smaller than the entrance of said second baffle means.

6. The apparatus according to claim 5 in which said medium introducing means includes:

manifold means for connection to a pressurized source of medium;

a plurality of openings in said one end wall of said tank and communicating with said manifold means;
and means to control the quantity of medium flow through each of said openings.

7. The apparatus according to claim 6 in which:
some of said openings in said one end wall communicate within said first baffle means and the remainder communicate exterior of said first baffle means;
and said control means of said medium introducing means varies the size of each of said openings in said one end wall exterior of said first baffle means.

8. The apparatus according to claim 7 including means mounted on each of said first and second baffle means in overlapping relation to each other to provide a continuation of said first and second baffle means in the space between the ends of said first and second baffle means, said mounted means enabling said arms of said rotary means to pass therethrough during rotation of said rotary means.

9. The apparatus according to claim 5 in which said medium introducing means includes means to introduce more than half of the medium into said tank within said first baffle means.

10. The apparatus according to claim 9 including means mounted on each of said first and second baffle means in overlapping relation to each other to provide a continuation of said first and second baffle means in the space between the ends of said first and second baffle means, said mounted means enabling said arms of said rotary means to pass therethrough during rotation of said rotary means.

11. The apparatus according to claim 4 including means mounted on each of said first and second baffle means in overlapping relation to each other to provide a continuation of said first and second baffle means in the space between the ends of said first and second baffle means, said mounted means enabling said arms of said rotary means to pass therethrough during rotation of said rotary means.

12. The apparatus according to claim 1 in which said medium introducing means includes:
manifold means for connection to a pressurized source of medium;
a plurality of openings in said one end wall of said tank and communicating with said manifold means;
and means to control the quantity of medium flow through each of said openings.

13. The apparatus according to claim 12 in which:
some of said openings in said one end wall communicate within said first baffle means and the remainder communicate exterior of said first baffle means;
and said control means of said medium introducing means varies the size of each of said openings in said one end wall exterior of said first baffle means.

14. The apparatus according to claim 1 in which said medium introducing means includes means to introduce more than half of the medium into said tank within said first baffle means.

15. The apparatus according to claim 1 in which said first baffle means has its exit smaller than the entrance of said second baffle means.

* * * * *

UNITED STATES PATENT AND TRADEMARK OFFICE

CERTIFICATE OF CORRECTION

PATENT NO. : 4,409,098

DATED : October 11, 1983

INVENTOR(S) : Billy T. Burke

It is certified that error appears in the above—identified patent and that said Letters Patent is hereby corrected as shown below:

Column 1, line 44, "toards" should read --- towards ---.

Column 4, line 63, "percent" should read --- per cent ---.

Column 5, line 67, after "63" insert --- and ---.

Column 9, line 27, "arm" should read --- arms ---.

Column 9, line 32, "whenever" should read --- wherever ---.

Signed and Sealed this

*Twenty-eighth* Day of *February 1984*

[SEAL]

*Attest:*

GERALD J. MOSSINGHOFF

*Attesting Officer*

*Commissioner of Patents and Trademarks*